United States Patent [19]

Oeschger et al.

[11] 4,174,145

[45] Nov. 13, 1979

[54] HIGH PRESSURE ELECTRICAL INSULATED FEED THRU CONNECTOR

[75] Inventors: Joseph E. Oeschger, Palo Alto; James E. Berkeland, San Jose, both of Calif.

[73] Assignee: The United States of America as represented by the United States Department of Energy, Washington, D.C.

[21] Appl. No.: 755,510

[22] Filed: Dec. 29, 1976

[51] Int. Cl.[2] ..... H01B 17/26; H01R 7/02

[52] U.S. Cl. ..... 339/94 A; 174/152 GM; 339/275 R

[58] Field of Search ..... 339/94 A, 275; 174/18, 174/50, 55, 151, 152

[56] References Cited

U.S. PATENT DOCUMENTS

| | | | |
|---|---|---|---|
| 1,697,165 | 1/1929 | Dallenbach | 174/151 X |
| 2,934,589 | 4/1960 | Sykora | 174/18 |
| 3,007,130 | 10/1961 | Martin | 339/275 R X |
| 3,134,230 | 5/1964 | Lynch | 174/18 |
| 3,853,390 | 12/1974 | Dekoeyer et al. | 339/275 R |

*Primary Examiner*—Roy Lake
*Assistant Examiner*—E. F. Desmond
*Attorney, Agent, or Firm*—Thomas E. Kristofferson; Randall G. Erdley

[57] ABSTRACT

A feed-thru type hermetic electrical connector including at least one connector pin feeding through an insulator block within the metallic body of the connector shell. A compression stop arrangement coaxially disposed about the insulator body is brazed to the shell, and the shoulder on the insulator block bears against this top in a compression mode, the high pressure or internal connector being at the opposite end of the shell. Seals between the pin and an internal bore at the high pressure end of the insulator block and between the insulator block and the metallic shell at the high pressure end are hermetically brazed in place, the first of these also functioning to transfer the axial compressive load without permitting appreciable shear action between the pin and insulator block.

11 Claims, 3 Drawing Figures

HIGH PRESSURE ELECTRICAL INSULATED FEED THRU CONNECTOR

BACKGROUND OF THE INVENTION

1. FIELD OF THE INVENTION

The invention relates generally to electrical connectors, and more specifically, to electrical connectors of the feed-thru type used to provide an electrical connection through the wall of a pressurized vessel.

2. DESCRIPTION OF THE PRIOR ART

The problem of making an electrical connection through the wall or bulkhead of a pressurized vessel is, of course, a very old one. Some approaches which have been employed in the past include incapsulation where the feed-thru pin or conductor or terminal is held in position and sealed to its housing or support structure through the use of a suitable incapsulant such as an epoxide, a thermoset plastic material, a thermoplastic material or a silicone sealer or the like. Selection of sealing materials in this incapsulation approach depends upon environmental conditions and extremes to be encountered and also on the magnitude of the pressure differential which the feed-thru device must resist.

The employment of glass-to-metal seal technology has provided a basis for the feeding through of a pin or terminal. In such arrangements, the pin or terminal is held in position and/or sealed to its housing or support structure by the use of a glass compression seal or a mismatched glass-to-metal seal of the "housekeeper" type.

Ceramic-to-metal seals have also been employed for holding the feed-thru pin or terminal in position and/or sealing it to its housing or support structure. Metalized ceramics and ceramic-to-metal transition pieces permit the attachment of metal pieces thereto by brazing or hard soldering methods. Such ceramic insulating materials with metalized areas thereon have been known and used in the vacuum capacitor and circuit interrupter arts for many years.

The incapsulation concept first recited above suffers from poor reliability due to the difficulty of maintaining long-term "wetting" of the incapsulant to the structural members under high temperature and thermal shock conditions, especially in the presence of various fluids such as water, steam and radioactive liquids and gases. Moreover, incapsulants of the types described tend to age rapidly under the conditions imposed.

Glass-to-metal seals may be basically of two types, i.e., compression seals and "housekeeper" type. To keep the seal in a proper state of compression throughout wide temperature and pressure changes in the presence of fluids (including the aforementioned water, steam, and radio-active fluids) is a very difficult one. Still further, there is a tendency of glasses used for compression seals to have poor resistance to erosion caused by water and steam, etc. Then, too, there is the fact that the compression seal glass material has relatively poor structural strength and very low ductility and malleability which reduce its ability to withstand forces generated in handling and the aforementioned hostile environments on the high pressure side of feed-thru.

In the so-called "housekeeper" concept, the physical size of the necessary glass-to-metal seal subassembly makes it very difficult to construct a connector assembly of small size. The temperatures and pressures experienced in the very rigorous service conditions of water, steam and radio-active fluids under pressure and at relatively high temperature exceed the practical strength capabilities of the metal portion of the seal, be it copper, nickel-iron, or kovar. In high temperature aqueous environments, glasses used for the "housekeeper" type seal are quite susceptible to erosion. Finally, in respect to glass seals, the inherent restriction on assembly techniques imposed by the relatively low temperature capability of the metal-to-glass subassembly tend to rule out such processing steps as furnace brazing and the like.

While ceramic materials are inherently very desirable, their prior art use (as metalized ceramic) require that thin metal sections join the ceramic to the housing or support structure, and these parts are generally incapable of withstanding the large axial force generated by use of the connector in the high pressure, high temperature environment. It has proven to be very difficult to design and construct a flexible ceramic-to-metal seal which is functional and yet does not tend to separate radially from either ceramic or its support mechanism under the action of the high pressure differential and expansion forces introduced by high temperature in service.

Some prior art United States patents dealing with various aspects of the general problem include U.S. Pat. Nos. 3,455,708; 3,660,593; 3,685,005; 3,735,024; and 3,850,501.

U.S. Pat. No. 3,455,708 deals with ceramic material for use in devices of the type to which the present invention applies. The reference shows a conductive pin passing through a ceramic insulating block and is sealed thereto, whereas the ceramic block itself is sealed within an aluminum shell or body. The device basically makes no allowance for repeated coefficient of expansion differential nor would it be expected to perform satisfactorily in a steam environment due to the glass frit (silicon dioxide binder) being subject to erosion with consequent void and leak formation. The device is also subject to fatigue induced by thermal cycling and the design is basically limited to small pin diameters.

In respect to the devices described in other aforementioned U.S. patents, many or all of the aforementioned comments apply.

The manner in which the present invention advances the state of the hermetic electrical feed-thru art, by providing a connector greatly superior to those of the prior art in respect to resistance to high pressure, high temperature, and other adverse environmental factors over the long term, will be understood as this description proceeds.

SUMMARY

In accordance with the present invention, an electrical feed-thru device is provided which is particularly adapted for electrical connection through the wall or bulkhead of a pressurized vessel. The vessel may also contain steam or other vapor and may be corrosive or radioactive in addition.

The invention overcomes the aforementioned prior art problems by providing a structure in which nearly all the axial loads generated by the pressure differential between the two ends of the device are carried by load-bearing members specifically designed for the purpose, thus freeing the ceramic-to-metal interfaces from these loads. The structure of the device according to the invention provides for compression abutments between the ceramic insulator blocks associated with each conductive pin employed and the metallic bodies of the connector. An axial compression force resisting arrangement is also provided to transfer the load from the conductive pins to the ceramic block insulator.

The ceramic-to-metal seal elements of the invention are designed such that, as the pressure differential across the device from the high pressure to ambient pressure ends is increased, the ceramic-to-metal seats are forced into tighter relationship at the compression abutments and the metalized ceramic-to-metal seal joints are urged into tigher radial fit. This results in improved support for the seals over their whole working length and effectively eliminates ceramic-to-metal seal distortion and distortion of the feed-thru pin or terminal as causes of failure.

The seal elements or transition joints are such that they allow for mismatch of the thermal expansion coefficients of various materials used.

The entire device according to the invention relies upon techniques and processes well known in the vacuum capacitor and interrupter arts. This includes the so-called furnace brazing operation in which the brazing material is introduced during assembly as preformed discs, washers and rings, as appropriate. During the furnace brazing operation, these formed parts of the brazing material melt, "wet" the adjoining parts and form hermetic braze joints of considerable mechanical strength and very effective sealing qualities. As aforementioned, this technique and the process for metalizing the surface of the ceramic insulator material, so that brazing can be accomplished directly to it, are well known in the aforementioned vacuum capacitor and interrupter prior art. One example of a vacuum capacitor and its processing for manufacture is contained in U.S. Pat. No. Re. 27,900. The furnace brazing technique, jigging for it, and metalizing of ceramic surfaces for brazing directly thereto are described and referenced in that patent, and such known processes and techniques are fully applicable to the device of the present invention.

The details of implementation of a representative embodiment of the present invention are hereinafter presented.

DESCRIPTION OF THE PREFERRED EMBODIMENT

Figure 1:
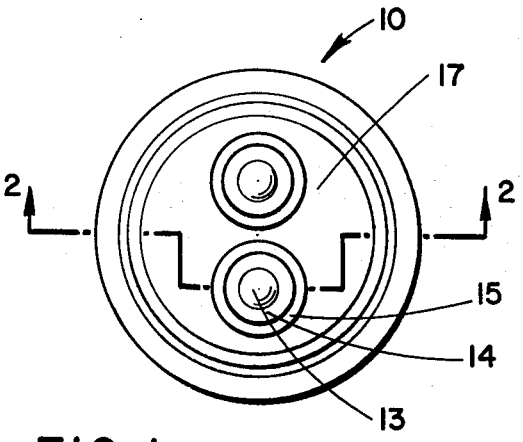
FIG. 1 is an end view from the outside (ambient) end of the illustrated and described feed-thru connector.

For purposes of description, all three figures will be referred to contemporaneously and interchangeably.

A typical feed-thru arrangement for making an electrical connection between the interior of a pressurized vessel and the exterior ambient conditions is illustrated as a detachable connector, generally at 10 in the figures. In accordance with this showing, the entire assembly has a high pressure end 11 and an ambient, outer or external end 12, in accordance with which the external end 13A of the pin 13 projects externally to receive a socket electrical connector member within the bore 31 into the end 12 of the metallic body 17. The extremity of the body 17 at this end 12 is shown typically threaded at 18 to facilitate attachment of a mating connector part. Of course, such matters as the thread 18 and the shape of the pin 13A are purely design matters subject to the discretion of the designer.

FIG. 1 shows two pins and their related assemblies, however, the description of one of these with its insulating block, seals, etc., is sufficient, since the other, or all other pins in the even there are more than two, are substantially identical.

Figure 3:
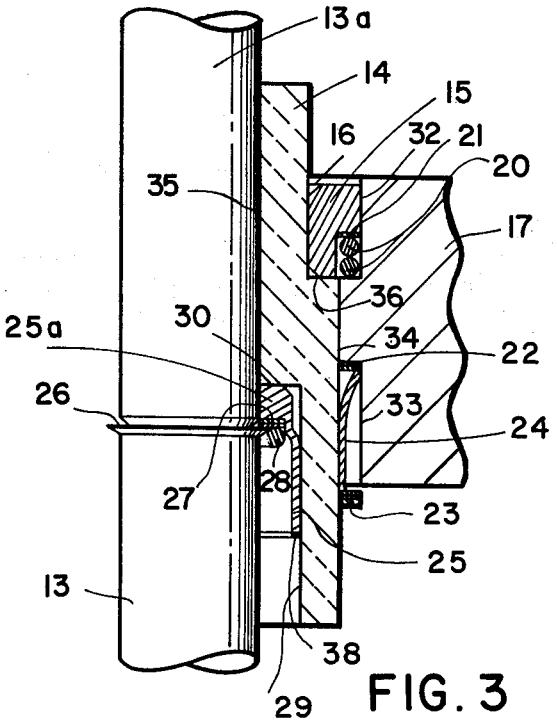
FIG. 3 is an enlarged view of portions of the showing of FIG. 2, for clarity.

The present invention relies upon the unique structure as illustrated in magnified form at FIG. 3, and accordingly, many other variations are possible building upon the invention and the inventive concepts.

Figure 2:
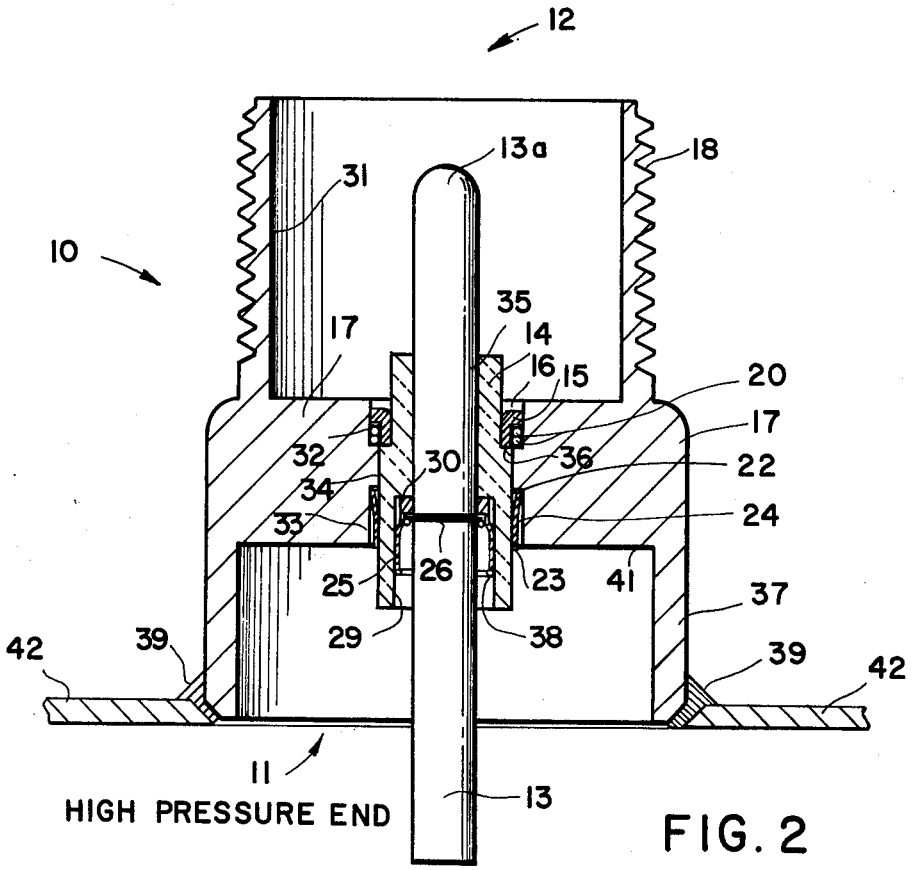
FIG. 2 is a sectional view taken through FIG. 1 as marked.

If the pin 13 and 13A were in the form of a threaded stud for a lug-bolted connection, for example, the entire threaded portion of the body as shown in FIG. 2 might be eliminated.

In FIG. 2, the flange 18 is illustrated welded to the body 17 at 39. This flange 18 might be, for example, the bulkhead of a pressure-containing vessel or might be an extensive barrier defining an area on the high pressure end 11 subject to explosion.

Through the heavy central web of the body 17, a bore (which may also be referred to as a body bore or a first bore) is provided of sufficient diameter to receive the ceramic insulator block 14 maximum diameter to slide axially therein. This insulator block 14 is fabricated of alumina oxide ceramic material such as is well known and is referred to as a prior art material in the vacuum capacitor and interrupter arts.

It will be noted that the ceramic block 14 has an integral shoulder 36 which bears on a ring 15, of L-shaped cross section, which is securely brazed to the bore (counterbore) 32 in the web of the body 17.

In the furnace brazing process, which is to be used in the production of devices according to the invention, the actual brazing material is inserted during assembly in the form of fabricated or formed parts, such as rings, washers, discs, etc. At the brazing oven temperature, this brazing material melts, "wets" the adjacent parts, and fuses firmly thereto upon cooling.

At this point in the specification, it should be pointed out that at least those portions of ceramic insulator block 14 to which the brazing material is fused are metalized according to a well known process, such as referred to in aforementioned U.S. Pat. No. Re. 27,900, and otherwise known in the prior art.

In FIGS. 2 and 3, these fabricated parts of braze material are illustrated as such, i.e., the assembly is depicted as it would be essentially ready for the furnace brazing operation. Thus, the two rings of brazing material 20 will fuse the smaller outside diameter and the underside of the ring of larger diameter of part 15 to the bore 32 of 17. This bore 32 is also hereinafter referred to as a second counterbore.

At this point in the description, it should be noted that the part 15 operates as a compression stop against the shoulder 36 of block 14 to resist the thrust resulting from the high pressure extant at 11. There is no substantial hermetic sealing effect required in the brazing of 15 to 17, and one variation which may suggest itself to the skilled designer in this art would be the formation of the body web 17 to provide an integral machined annular ring in place of 15. The basic reason for including the part 15 as a separate piece is the desire to provide a relatively soft malleable compression stop against the shoulder 36 of the ceramic block 14. In this way, a "seating" effect can be achieved, minimizing the hazard of chipping or cracking of the ceramic material upon application of a high pressure at 11. If the aforementioned variation were to be employed, that is, if the internal shoulder of the body member 17 were to be formed as an integral part of the relatively hard (stainless steel, for example) material of 17, a flat seating washer at the shoulder abutment 36 could be employed to provide the same malleable material against the ceramic. The part 15 would normally be of a material such as copper or the like, and the washer for the alternative configuration could also be copper.

It would be normal to assemble the device by first pressfitting the compression stop 15 fitted with brazing material rings 20 and preferably a washer 21 of this material into the counterbore 32. The annular void space 16 is shown as a design expedient, increasing the axial length of the outside surface of the insulator block 14 to increase the length of the electrical leakage path axially along the outside surface of 14 in that vicinity. Depending upon the voltages encountered, this gap 16 may or may not be necessary, and part 15 and counterbore 32 could be sized to bring the upper surface of 15 flush with the bottom inside of the bore 31 (upper and bottom being as illustrated in FIG. 2).

As the next step in assembly, the body shell member 17 may be inverted, i.e., with the end 12 downward, then the insulator block 14 is inserted axially from end 11. The maximum diameter of 14 fits snugly within the body bore along 34 but not to the extent of a press-fit which might be damaging to the ceramic material of 14. The fitting of the pin (identified as 13 below the burr or chamfer 26 and as 13A about it) may be inserted through the insulator bore (otherwise referred to herein as a second bore) 35, the cup-shaped inner seal and expansion member or part 25 having first been inserted in the counterbore in the high pressure end of the insulator block 14. A chamfer or burr 26 is provided which may be thought of as dividing the conductive pin between 13 and 13A, the high pressure and external ends, respectively. This burr or chamfer is, of course, only a surface treatment of the conductive rod and is in lieu of fabrication of the rod with a larger diameter at 13, as compared to 13A, the latter being an acceptable, albeit more expensive, alternative, however. With the braze material, washer or washers 27, and a ring of braze material 28 in place, an assembly is generated as will tend to limit the protrusion of 13A, the burr 26 engaging the braze material and the relatively heavy annular bottom section 25A of the cup-shaped part 25. In the furnace brazing operation, a ring or washer of brazed material at 38 serves to hermetically bond the outer rim of 25 to the insulator counterbore 29 at 38. The melting of 27 and 28 similarly provides a hermetic seal between the pin 13/13A and the member 25. Fabrication of the part 25 from copper provides the resilience and expansion/contraction freedom which are important at this point. Finally, in the assembly process, a part 24 is inserted in a counterbore 33. This part 24 is in the form of a frustum of a conical shell and is preferably of nickel-iron or some other material which relatively closely matches the coefficient of thermal expansion of the ceramic material. Although part 24 is shown as curving a particular way from bottom to top (as viewed on FIG. 3), it is possible to reverse this orientation. As shown, braze material at 22 and 23 provides hermetic sealing during the furnace braze operation at the two axial extremes of this shell frustum. At 23 and, for that matter, at point 38, the ceramic is understood to be metalized for braze adherence thereto.

From an understanding of the foregoing, it is evident that the bulk of the axial force exerted from pressure at 11 is resisted by the contact of shoulders, ceramic block 36 against compression stop 15; and in respect to axial forces extant along 35, these are resisted by the contact of the cup-shaped piece 25A (bottom) at 30. Consideration of areas exposed to the pressure differential indicate that the larger axial forces are resisted by 15, since here, the sum of the pin and ceramic block cross sections produce the force to be resisted.

Obviously, as may suit a particular application, the portion 37 of the shell or body part 17 may be axially lengthened or shortened, even to the extent of bringing the surface 41 of 14 down to the flange 18.

Various additional modifications and variations of this structure within the spirit of the present invention will suggest themselves to those skilled in this art. Accordingly, it is not intended the invention should be considered limited by the drawings or this description, these being typical and illustrative only.

We claim:

1. In an hermetically sealed electrical connector having a ceramic insulating block supported within a body bore through the metallic body of said connector and at least one conductive pin extending through an axial insulator bore in said ceramic block, said connector being adapted for installation through the wall of a pressurized vessel whereby said pin, said body and said ceramic block each have a high pressure end and an external end, the combination comprising:

first means forming an internal body shoulder facing said high pressure end adjacent and within the external end of said body bore;

second means integral with said ceramic block forming a radially external shoulder which bears against said internal body shoulder in response to thrust force generated by pressure at said high pressure ends;

third means comprising an insulator counterbore extending into said high pressure end of said ceramic block by a predetermined distance, said insulator counterbore being of larger diameter than said conductive pin to generate a first annular cavity surrounding said pin within said insulator counterbore;

fourth means comprising a cup-shaped metal member with a central hole in the base thereof, said conductive pin passing axially therethrough, said cup-shaped member having a relatively thin rim directed outward at said high pressure end and in contact with the inside surface of said counterbore, said base of said member bearing against the internal shoulder generated within said ceramic block by said insulator counterbore;

hermetic seals effected by brazing of said cup-shaped member rim to the inside surface of said insulator counterbore and said base of said member to said conductive pin about said hole;

and additional seal and expansion compensating means including a first counterbore into said metallic body a predetermined distance from said high pressure end, said first counterbore providing a second annular cavity between the radially outward surface of said ceramic block and the radially inside surface of said second counterbore, and including a resilient metallic sleeve having a wall thickness less than the radial clearance provided in said second annular space, said sleeve being hermetically brazed to said body within said first counterbore along one axial extremity of said sleeve and to the wall of said ceramic block within said first counterbore along the other axial extremity of said sleeve, thereby to provide for differential expansion of said ceramic block and said metallic body by resilient deformation of said sleeve.

2. In an hermetically sealed, feed-through, electrical connector for providing an external electrical connection into a higher pressure environment, the combination comprising:

a metallic body shell having a relatively thick web, said body being mountable through the bulkhead of a vessel containing said higher pressure environment, said web having an axial body bore therethrough from an external surface thereof to an internal surface in contact with said higher pressure environment;

an insulating block installed within said body bore and a conductive pin through an axial insulator bore in said insulating block, said insulator bore and said conductive pin being substantially coaxial with respect to said body bore, said conductive pin extending beyond said insulating block both externally and within said higher pressure environment;

thrust resisting means providing an internal first shoulder within said body bore adjacent to said internal surface of said body web, said first shoulder effectively reducing the inside perimeter of said body bore for a fraction of said body bore axial length, said insulator block having an outer perimeter shoulder formed by a step reduction of the radially outer perimeter of said insulating block adjacent said external web surface, said insulating block outer perimeter shoulder bearing against said first shoulder in response to said higher pressure environment;

an insulator counterbore of circular cross section and partially into said insulating block from the end thereof in contact with said higher pressure environment, said insulator counterbore being substantially coaxial with said conductive pin and larger in diameter than said pin;

and a generally cup-shaped, first seal member of resilient metal, said member having a relatively flat bottom and an upturned rim of circular cross-section, said first seal member having a hole in said bottom and being placed within said insulator counterbore with said rim in the direction of said higher pressure environment, said rim being hermetically sealed to the inside surface of said insulator counterbore, said pin passing through and being sealed to said hole.

3. Apparatus according to claim 2 in which said bores, counterbores, and insulating block are of circular cross section.

4. Apparatus according to claim 3 in which said insulating block is of the alumina oxide type ceramic material.

5. Apparatus according to claim 4 in which said hermetic sealing between said first seal member and said pin and between said first seal member and said inside surface of said insulator counterbore are effected by hermetic brazing, said inside surface of said insulator bore being a metalized surface on said ceramic material to receive said braze.

6. Apparatus according to claim 5 including a first counterbore in said body web from said high pressure end thereby creating a first annular cavity, and in which there is included a resilient metallic expansion seal member in the shape of a frustum of a conical metallic shell within said second cavity, said shell frustum having a wall thickness less than the radial width of said first cavity, said shell frustum being hermetically brazed to a metallized portion of said perimeter of said insulating block along one axial extremity thereof and to said first counterbore at its other axial extremity.

7. Apparatus according to claim 6 in which said shell frustum is of a metal having a coefficient of expansion at least approximating that of said ceramic material of said insulating block.

8. Apparatus according to claim 2 in which a second counterbore at least as large in diameter as said larger insulating block diameter is included extending a predetermined dimension axially from said external end, thereby forming a second annular cavity between said second counterbore and the smaller diameter of said insulator block, and in which said internal shoulder is formed by a copper ring brazed in place in said second annular cavity.

9. Apparatus according to claim 6 in which a second counterbore at least as large in diameter as said larger insulating block diameter is included extending a predetermined dimension axially from said external end, thereby forming a second annular cavity between said second counterbore and the smaller diameter of said insulator block, and in which said internal shoulder is formed by a copper ring brazed in place in said second annular cavity.

10. Apparatus according to claim 7 in which said shell frustum is of nickel-iron material.

11. In an hermetically sealed feed-through electrical connector assembly having a metallic body shell fixed and hermetically sealed into an aperture in a wall of a pressurized vessel, the combination comprising:

a ceramic insulator block extending within and through said body shell and at least one conductive pin extending through said ceramic block;

first means comprising axially abutting, radially internal and external shoulders on said body shell and said ceramic block, respectively, said shoulders being arranged to be stressed into compressive contact in response to pressure within said vessel;

second means comprising axially abutting radially internal and external shoulders on said ceramic block and said conductive pin, respectively, said second means shoulders being arranged to be stressed into compressive contact in response to pressure within said vessel;

and resilient metallic seals between said pin and said ceramic block and between said ceramic block and said body shell adjacent the high pressure end of said connector assembly.

* * * * *